US007355568B2

(12) United States Patent
Homma

(10) Patent No.: US 7,355,568 B2
(45) **Date of Patent: *Apr. 8, 2008**

(54) DRIVING METHOD FOR PLASMA DISPLAY PANEL AND DRIVING CIRCUIT FOR PLASMA DISPLAY PANEL

(75) Inventor: Hajime Homma, Tokyo (JP)

(73) Assignee: Pioneer Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/491,303

(22) Filed: Jul. 24, 2006

(65) Prior Publication Data

US 2006/0262043 A1 Nov. 23, 2006

Related U.S. Application Data

(63) Continuation of application No. 09/794,182, filed on Feb. 27, 2001, now Pat. No. 7,098,873.

(30) Foreign Application Priority Data

Feb. 28, 2000 (JP) ..... 2000-051424

(51) Int. Cl.
*G09G 3/28* (2006.01)

(52) U.S. Cl. ..... 345/60; 345/66

(58) Field of Classification Search ..... 345/60–63, 345/66, 68, 75.2, 76; 315/169.1, 169.4, 484, 315/491, 514, 517, 520
See application file for complete search history.

(56) References Cited

U.S. PATENT DOCUMENTS 5,317,334 A 5/1994 Sano
5,854,540 A * 12/1998 Matsumoto et al. ..... 315/169.1
5,940,142 A 8/1999 Wakitani et al.
6,097,358 A 8/2000 Hirakawa et al.
6,104,361 A 8/2000 Rutherford
6,107,978 A 8/2000 Nagaoka et al.
6,323,880 B1 * 11/2001 Yamada ..... 345/690
6,337,674 B1 1/2002 Kim
6,340,960 B1 1/2002 Song et al.
6,384,802 B1 5/2002 Moon
6,407,506 B1 6/2002 Naka et al.
6,512,501 B1 * 1/2003 Nagaoka et al. ..... 345/66
6,518,977 B1 2/2003 Naka et al.
6,653,993 B1 * 11/2003 Nagao et al. ..... 345/60
7,098,873 B2 * 8/2006 Homma ..... 345/60

FOREIGN PATENT DOCUMENTS

| | | |
|---|---|---|
| JP | 08-320668 | 12/1996 |
| JP | 09-068947 | 3/1997 |
| JP | 09-179520 | 7/1997 |
| JP | 2737697 | 1/1998 |
| JP | 10-207426 | 8/1998 |
| JP | 10-319900 | 12/1998 |
| JP | 2000-039865 | 2/2000 |

* cited by examiner

*Primary Examiner*—Richard Hjerpe
*Assistant Examiner*—Mansour M. Said
(74) *Attorney, Agent, or Firm*—Drinker Biddle & Reath LLP

(57) ABSTRACT

A length of an addressing period in a first sub-field is made shorter as time from an end of a second sub-field which provides light emission just previously to the first sub-field in a frame including the first and second sub-fields to a start of the first sub-field decreases, and as the number of sustain pulses in the second sub-field increases.

8 Claims, 17 Drawing Sheets

FIG. 13

| | SF1 | SF2 | SF3 | SF4 | SF5 | SF6 | SF7 | SF8 | SF9 | SF10 |
|---|---|---|---|---|---|---|---|---|---|---|
| WEIGHT | 1 | 2 | 4 | 7 | 13 | 23 | 33 | 43 | 55 | 74 |
| GRADATION LEVEL | | | | | | | | | | |
| 0 | | | | | | | | | | |
| 1 | ○ | | | | | | | | | |
| 2 | | ○ | | | | | | | | |
| 3 | ○ | ○ | | | | | | | | |
| 4 | | | ○ | | | | | | | |
| 5～7 | SAME AS 1 TO 3 | | ○ | | | | | | | |
| 8 | ○ | | | ○ | | | | | | |
| 9～14 | SAME AS 2 TO 7 | | | ○ | | | | | | |
| 15 | | ○ | | | ○ | | | | | |
| 16～27 | SAME AS 3 TO 14 | | | | ○ | | | | | |
| 28 | ○ | | ○ | | | ○ | | | | |
| 29～50 | SAME AS 6 TO 27 | | | | | ○ | | | | |
| 51 | ○ | | ○ | | ○ | | ○ | | | |
| 52～83 | SAME AS 19 TO 50 | | | | | | ○ | | | |
| 84 | ○ | | ○ | | ○ | ○ | | ○ | | |
| 85～126 | SAME AS 42 TO 83 | | | | | | | ○ | | |
| 127 | ○ | ○ | | | ○ | ○ | ○ | | ○ | |
| 128～181 | SAME AS 73 TO 126 | | | | | | | | ○ | |
| 182 | | ○ | | ○ | | ○ | ○ | ○ | | ○ |
| 183～255 | SAME AS 109 TO 181 | | | | | | | | | ○ |

DRIVING METHOD FOR PLASMA DISPLAY PANEL AND DRIVING CIRCUIT FOR PLASMA DISPLAY PANEL

This is a continuation application of application Ser. No. 09/794,182, filed on Feb. 27, 2001, now U.S. Pat. No. 7,098,873, which is incorporated by reference herein in its entirety.

BACKGROUND OF THE INVENTION

1. Field of the Invention

The present invention relates to a driving method and a driving circuit for a plasma display panel to be used as flat televisions, information displays or the like, and more particularly to a driving method and a driving circuit for a plasma display panel in a reduced addressing period.

2. Description of the Related Art

In general, a plasma display panel has a number of advantages. That is, the panel features low profiles, quick response, eliminated screen flicker, and high display contrast. In addition, the panel can provide a comparatively large screen and spontaneous emission of light or multicolored light using phosphor materials.

Recently, these features allow the plasma display panel to have widespread use in the field of the computer-related display device, the color-picture display and the like.

The plasma display is divided into two types depending on the operating method. One is an AC plasma display in which the electrodes are coated with a dielectric layer and indirectly operated with alternating current discharges. The other is a DC plasma display in which the electrodes are exposed in a discharge space and operated with direct current discharges. The AC plasma display is further divided into two types. One is a memory-operated plasma display, which employs the memory of discharge cells, and the other is a non-memory-operated (refresh) plasma display. Incidentally, the luminance of the plasma display is proportional to the number of discharges. The plasma display of the aforementioned refresh type decreases in luminance with increase in capacity of display and is therefore employed for a plasma display small in capacity.

FIG. 1 is a perspective view illustrating an example of the structure of a display cell constituting an AC plasma display.

The display cell is provided with two insulating substrates 101, 102, which are made of glass. The insulating substrate 101 is a rear substrate and the insulating substrate 102 is a front substrate.

On the surface of the insulating substrate 102 opposed to the insulating substrate 101, there are provided transparent scan electrodes 103 and transparent common electrodes 104. The scan electrode 103 and common electrode 104 extend in the horizontal (lateral) direction of the panel. In addition, trace electrodes 105, 106 are disposed in overlapping relation with the scan electrode 103 and common electrode 104, respectively. For example, the trace electrodes 105, 106 are made of metal and provided to reduce the electrode resistance between each of the electrodes and an external driving unit. There are also provided a dielectric layer 112 for covering the scan electrode 103 and common electrode 104, and a protective layer 114 made of magnesium oxide for protecting the dielectric layer 112 from a discharge.

On the surface of the insulating substrate 101 opposed to the insulating substrate 102, there are provided data electrodes 107 orthogonal to the scan electrode 103 and common electrode 104. The data electrode 107 thus extends in the vertical (transverse) direction of the panel. In addition, there are provided bulkheads 109 for defining the display cells in the horizontal direction. Moreover, there are provided a dielectric layer 113 for covering the data electrode 107 and phosphor layers 111 for converting to visible light 110 an ultraviolet radiation, which is generated by discharge of a discharge gas on the side of the bulkheads 109, and the surface of the dielectric layer 113. In addition, a discharge gas space 108 is defined by the bulkheads 109 in the gap defined by the insulating substrates 101, 102. In this discharge gas space 108, filled is a discharge gas such as helium, neon, or xenon, or a mixture of these gases.

FIG. 2 is a schematic diagram illustrating the arrangement of the electrodes of the AC plasma display panel.

There are provided light-emitting display cells at the intersections of the scan electrodes S1-Sn (103) and common electrodes C1-Cn (104), disposed in parallel spaced relation to one another, and the data electrodes D1-Dm (107) disposed in orthogonal relation to the scan and common electrodes. Accordingly, one display cell is provided with one scan electrode, one common electrode, and one data electrode. Thus, the screen has the total number of (n×m) display cells, where n is the number of the scan electrodes and common electrodes, and m is the number of the data electrodes.

Now, the writing-selective-type driving operation will be explained below, which is employed by a conventional plasma display configured as described above. FIG. 3 is a timing chart illustrating the writing-selective-type driving operation for the conventional plasma display. Each sub-field consists of four periods; a sustain-erasing period, a priming period, an addressing period, and a sustaining period, which are set in sequence.

First, during the sustain-erasing period, a sustain erase pulse Pse-s of negative polarity is applied to the scan electrodes Si. The sustain erase pulse Pse-s of negative polarity has the shape of a sawtooth pulse. This allows the wall charges built up on each electrode by the light emission in the previous sub-field to be erased. At the same time, all the discharge cells in the panel are made uniform irrespective of the presence or absence of light emission in the previous sub-field.

Then, during the priming period, a sawtooth prime pulse Ppr-s is applied to the scan electrodes, while a rectangular prime pulse Ppr-c is applied to the common electrodes. The prime pulse Ppr-s has positive polarity, whereas the prime pulse Ppr-c has negative polarity. The application of the prime pulses Ppr-s and Ppr-c causes a priming discharge to occur in a discharge space near the gap between the scan and common electrodes, thereby generating active particles to facilitate the subsequent writing discharge in the cell. At the same time, this causes wall charges of negative polarity to build up on the scan electrode, wall charges of positive polarity on the common electrode, and wall charges of positive polarity on the data electrode. Subsequently, a charge control pulse Ppe-s is applied to the scan electrode. This causes a weak discharge to occur to reduce the wall charges of negative polarity built up on the scan electrode, the wall charges of positive polarity on the common electrode, and the wall charges of positive polarity on the data electrode.

During the subsequent addressing period, a light-emitting discharge cell is selected. A writing discharge occurs only in the cell selected by the scan pulse Psc-s of negative polarity applied to the scan electrode and the data pulse Pd of positive polarity applied to the data electrode. Wall charges build up on the electrodes of the discharge cell located at the site where light is to be emitted during the subsequent sustaining period. The occurrence of the writing discharge causes wall charges to build up in the discharge cell. In contrast to this, discharge cells in which no writing discharge has occurred still remain unchanged with less wall charges left after having been erased. Such a writing discharge is to occur when the scan and data pulses overlap with each other. As shown in FIG. 4, it requires some time for the writing discharge to occur from the time of application of the pulses. This time is called a "writing discharge delay time (Tw), which is used to determine a scan pulse width Wsc and data pulse width Wd.

A gas discharge occurs as follows. First, an external voltage is applied to cause space charges such as electrons and ions present in the discharge space to move through the gap between the electrodes. Then, the ions collide with the electrodes to generate secondary electrons, which in turn collide successively with gas atoms or molecules in the discharge gas. Thus, secondary electrons are increased exponentially and the gas atoms collided therewith are excited, thereby generating the gas discharge. Therefore, the time required for the generation of a discharge is divided into two periods. A first period is time Ts during which the external voltage is applied to cause space charges such as electrons and ions present in the discharge space to move through the gap between the electrodes to collide with the electrodes. The second period is time Tf during which the ions having collided with the electrodes collide successively with the gas atoms or molecules in the discharge space to cause secondary electrons to exponentially increase and the gas atoms having collided with the ions to be excited. Of these periods, the latter time Tf is referred to as the formation delay time, which is determined by the kind and pressure of the gas, the applied voltage, the cell structure and the like, and has a certain definite value under a constant condition. On the other hand, the former time Ts is referred to as the statistical delay time, which takes on values that vary depending on the amount of excited molecules and atoms present in the space, the amount of the wall charges built up near the electrodes in the discharge cell, and the level of easiness of the emission of secondary electrons from a MgO protective layer formed on the electrodes. That is, the writing discharge delay time Tw is expressed by $Tw=Tf+Ts$. The relation of $(Wsc, wd) \geqq Ts+Tf$ has to be satisfied, where Wsc is the scan pulse width and wd is the data pulse width, which are necessary to positively generate a writing discharge and thereby form wall charges. The statistical delay time Ts is strongly affected by the excited molecules and atoms present in the discharge space and decreases with increase in number of excited molecules and atoms present in the discharge space.

In this context, the scan pulse width Wsc and the data pulse width Wd were determined in consideration of the priming effect provided by a priming discharge. In addition, a longer period of time from the end of the priming period to a write operation would cause the priming effect to be weakened and the writing discharge delay time to become longer. Thus, there is such a method available that allows the scan and data pulse widths Wsc, Wd to be made longer according to the time elapsed from the end of the priming period (Japanese Patent No. 2737697).

The sustaining period subsequent to an addressing period is a period for display emission, during which a pulse application is initiated from the common electrode and then is followed by alternate applications of negative sustain pulses Ps-s and Ps-c to the scan and common electrodes, respectively. During this period, since a fairly small amount of wall charges is built up in the discharge cells where no write operation was carried out during the addressing period, the application of a sustain pulse to the discharge cells would result in no sustain discharge. On the other hand, in the discharge cells where the writing discharge was generated during the addressing period, positive charges are built up on the scan electrode and negative charges on the common electrode. This causes that the negative sustain pulse voltage applied to the common electrode and the wall charge voltage are superimposed on each other to cause the voltage between the electrodes to exceed the discharge initiation voltage, thereby generating a discharge.

Once a discharge is generated, wall charges are built up so as to cancel out the voltage applied to each of the electrodes. Therefore, negative charges are built up on the common electrode and positive charges are built up on the scan electrode. In addition, the subsequent sustain pulse has a positive voltage on the side of the scan electrode and is superimposed on the wall charge voltage to provide an effective voltage applied to the discharge space that exceeds the discharge initiation voltage, thereby generating a discharge. Hereinafter, the same process is repeated to sustain the discharge. Luminance is determined by the number of times of discharge.

FIG. 5 is a block diagram illustrating a driving circuit employed by a conventional plasma display. In addition, FIG. 6A is a diagram illustrating a driving circuit for the scan electrodes 103; FIG. 6B is a diagram illustrating a driving circuit for the common electrodes 104; and FIG. 6C is a diagram illustrating a data electrode driver 28.

On the horizontal end portions of the conventional plasma display panel, there are provided outlet portions, each on one end, for the scan electrodes 103 and the common electrodes 104 to be taken out therefrom, the driving circuits being connected to the outlet portions.

As a driving circuit for the scan electrodes 103, there is provided a scan pulse driver 21 for outputting a scan pulse to each of the scan electrodes 103. In addition, connected to the scan pulse driver 21 are a priming driver 22 for outputting prime pulses, a sustaining driver 23 for outputting sustain pulses, an erasing driver 24 for applying erase pulses, a scan base driver 25 for outputting scan base pulses, and a scan voltage driver 26 for outputting a scan voltage. Each of the drivers 21-26 constitutes a scan electrode driver 30 for driving the scan electrodes 103.

On the other hand, as a driving circuit for the common electrodes 104, there is provided a sustaining driver 27 for applying sustain pulses to all the common electrodes 104. Only the sustaining driver 27 constitutes a common electrode driver 31 for driving the common electrodes 104.

Furthermore, on a vertical end of the conventional plasma display panel, there is provided an outlet portion for the data electrodes 107 to be taken out therefrom, and the data electrode driver 28 is connected to the outlet portion as a driving circuit.

In addition, there is provided a drive controller 29 for switching the operation of each of the drivers in accordance with an image signal.

Incidentally, in FIGS. 6A to 6C, each driver is represented by a switch. However, the drivers may be constituted by physical switches or by devices such as the bipolar transistor or field effect transistor (FET).

One frame is divided into a plurality of sub-fields and a different number of sustain pulses are provided for each of the sub-fields. The sub-fields are then combined to express gradation. Therefore, the ratio of the numbers of the sustain pulses provided for each sub-field may be determined, for example, such that 1:2:4:8:16:32:64:128, thereby making it possible to express 256 ($=2^8$) levels of gradation.

In addition, a large image display area and a high average luminance level would significantly increase power consumption. In this context, a control method for preventing an increase in power consumption is employed. The control method is referred to as the PLE (Peak Luminance Enhancement). FIG. 7 is a circuit diagram illustrating a conventional plasma display employing a PLE control.

An image signal 55 inputted to the plasma display is converted with an image signal processing circuit 56 and a sub-field (SF) controller 57 to a signal for use with the plasma display.

The signal thus converted is inputted to an input signal average luminance level computing circuit 59 to compute the luminance level of the whole screen. Suppose that the average luminance level of the input signal is low (APL: low) or the display area is narrow. In this case, based on the results of the computation, a sustain pulse number controller 58 increases the number of sustain pulses to increase luminance. On the contrary, when the average luminance level is high (APL: high) or the display area is wide, the number of sustain pulses is decreased to limit the luminance. Consequently, the number of sustain pulses in each sub-field is controlled in each frame so as to provide a high peak luminance level on the large display area while an increase in power consumption is being prevented. An image processing portion 60 comprises the image signal processing circuit 56, the SF controller 57, the input signal average luminance level computing circuit 59, and the sustain pulse number controller 58.

Output signals from the SF controller 57 and the sustain pulse number controller 58 are inputted to the drive controller 29 to control the operation of the scan electrode driver 30, the common electrode driver 31, and the data electrode driver 28, which are connected to the scan electrodes, the common electrodes, and the data electrodes of a plasma display panel 51, respectively.

However, the aforementioned conventional driving method for an plasma display provides the total length of time of addressing periods in one frame equal to "the width of a scan pulse×the number of scan lines×the number of sub-fields", while the addressing period does not contribute to the display light emission. Suppose the length of the addressing period is increased and the number of sub-fields is increased to provide display with an increased number of gradation levels or the number of scan lines is increased to cope with higher resolution. This causes such a problem that a decrease in time to be assigned to the sustaining period in a frame will not provide for sufficient luminance. Furthermore, in some cases, reducing the width of the scan pulse to ensure the sustaining period may cause a reduction in probability of occurrence of a writing discharge, thereby leading to a problem such as a writing failure.

SUMMARY OF THE INVENTION

An object of the present invention is to provide a driving method and a driving circuit for a plasma display panel, which provide the panel with a reduced total addressing period while the drive property thereof is being kept under a good condition.

A driving method for a plasma display panel according to one aspect of the present invention comprises the step of making a length of an addressing period in a sub-field shorter as the number of sustain pulses for a sustaining period in said sub-field increases.

The length of the addressing period is made shorter as the number of sustain pulses increases according to the aspect of the present invention. This makes it possible to shorten the writing discharge delay time or a determinant factor of the width of scan and data pulses without degrading the driving property. This results in shortening the overall addressing period in a frame. Therefore, the total addressing period occupying a whole frame is considerably reduced when compared with a conventional one. Accordingly, the reduced period of time can be assigned to a sustaining period, thereby making it possible to increase the number of times of sustaining light emission to improve luminance and increase the number of sub-fields to improve the number of gradation levels. Furthermore, to provide higher resolution, the number of scan electrodes can be increased without causing a decrease in sustaining period.

A driving circuit according to another aspect of the present invention, comprises a period varying circuit which makes a length of an addressing period in a sub-field shorter as the number of sustain pulses for a sustaining period in said sub-field increases.

A period varying circuit makes the length of an addressing period shorter as the number of sustain pulses increases according to the aspect of the invention. This makes it possible to shorten the writing discharge delay time or a determinant factor of the width of scan and data pulses without degrading the driving property. This in turn makes it possible to shorten the overall addressing period.

BRIEF DESCRIPTION OF THE DRAWINGS

FIG. 13 is a view illustrating the weighting of each sub-field and the coding of input signals of a plasma display, which are employed by the second embodiment of the present invention.

DETAILED DESCRIPTION OF THE PREFERRED EMBODIMENT

Figure 1:
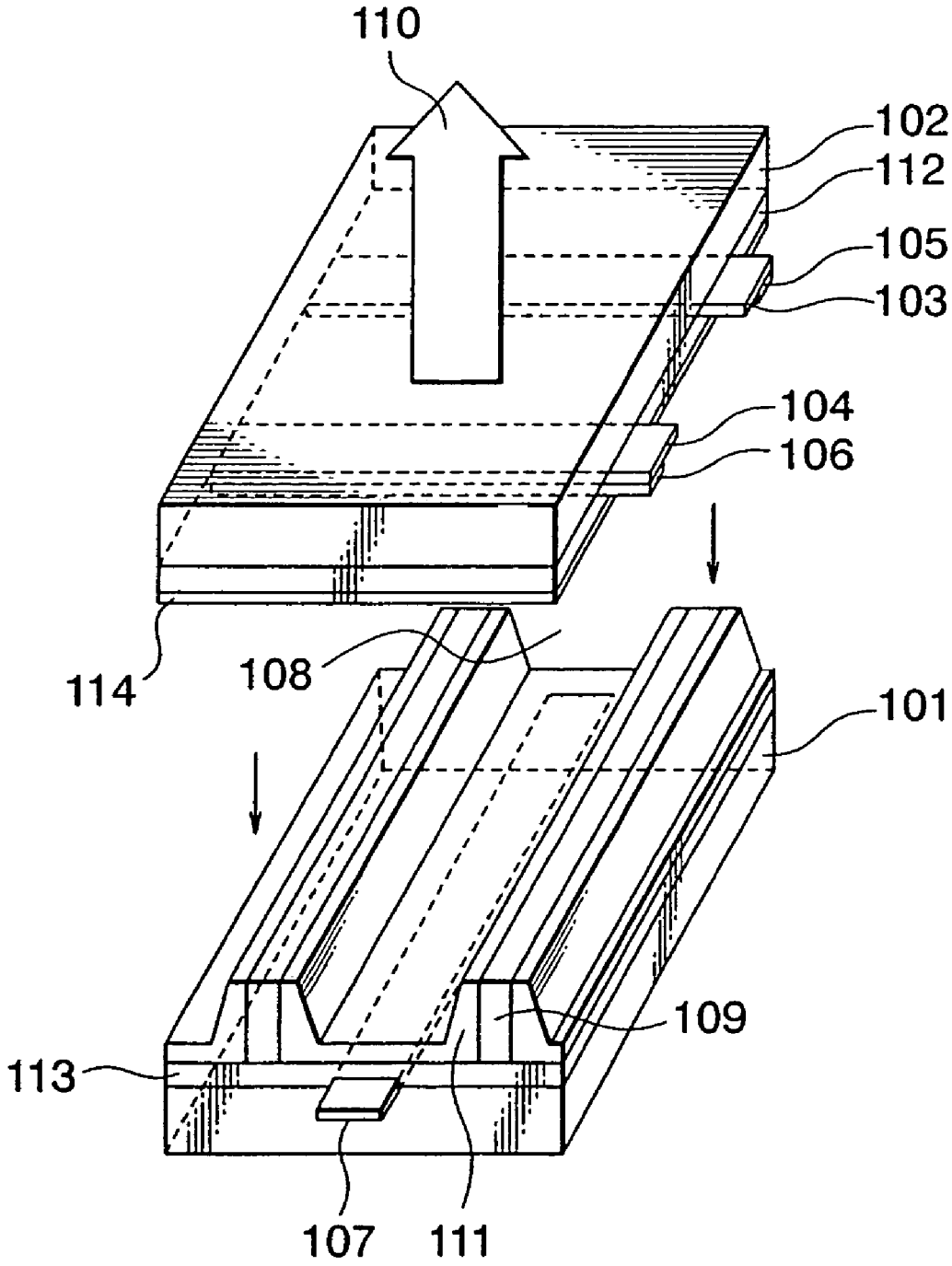
FIG. 1 (PRIOR ART)
FIG. 1 is a perspective view illustrating an example of the structure of a display cell constituting an AC plasma display.
Figure 2:
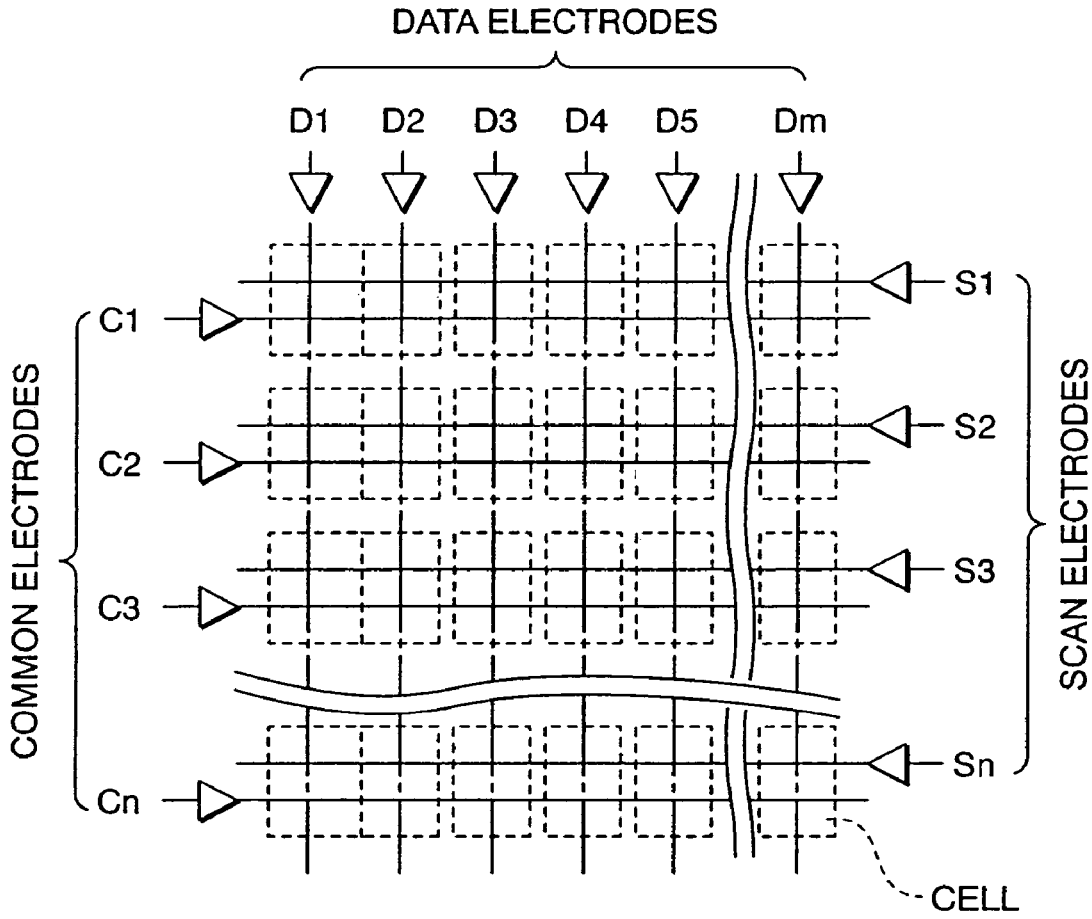
FIG. 2 (PRIOR ART)
FIG. 2 is a schematic diagram illustrating the arrangement of the electrodes of an AC plasma display panel.
Figure 3:
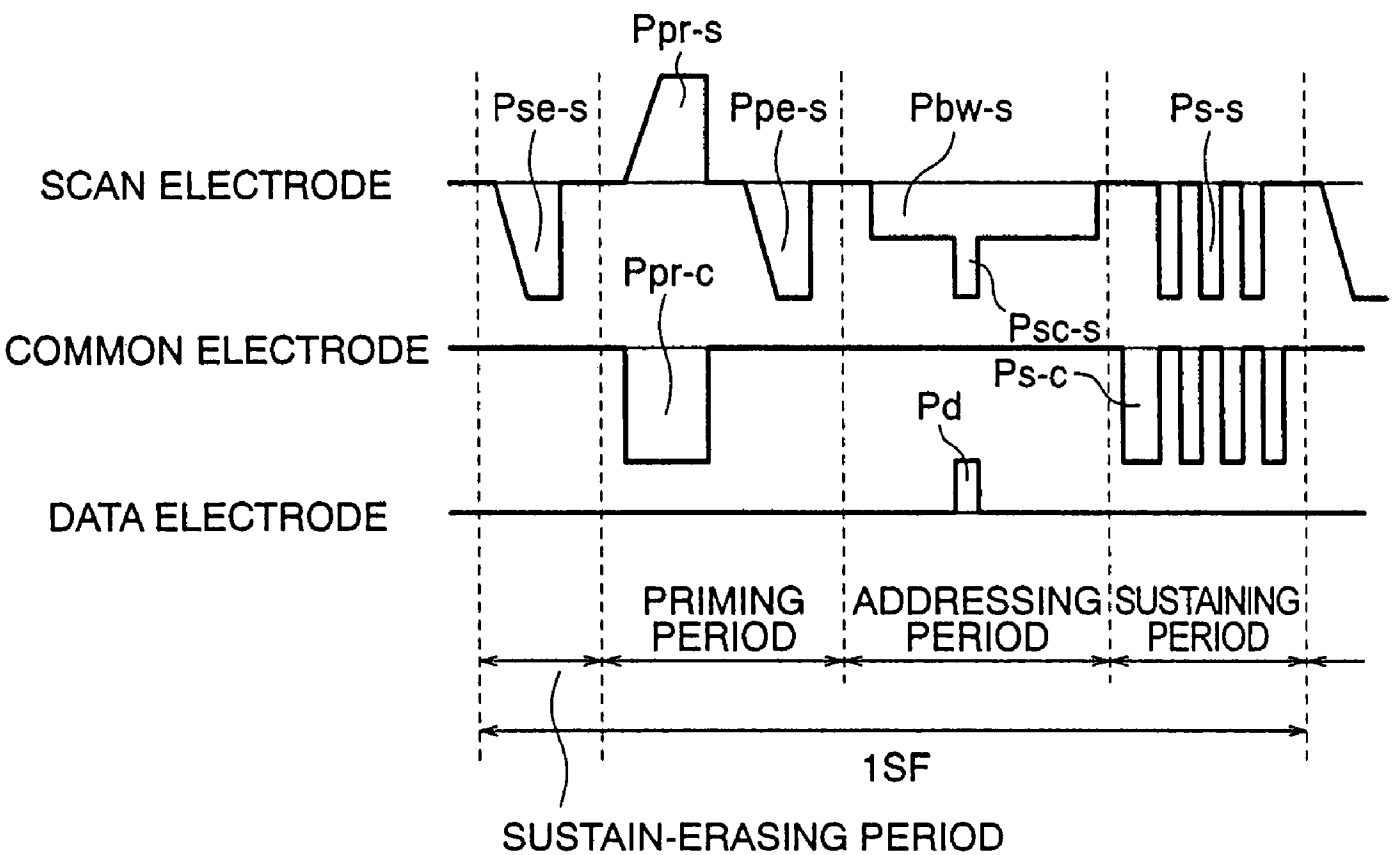
FIG. 3 (PRIOR ART)
FIG. 3 is a timing chart illustrating the writing-selective-type drive operation of a conventional plasma display.
Figure 4:
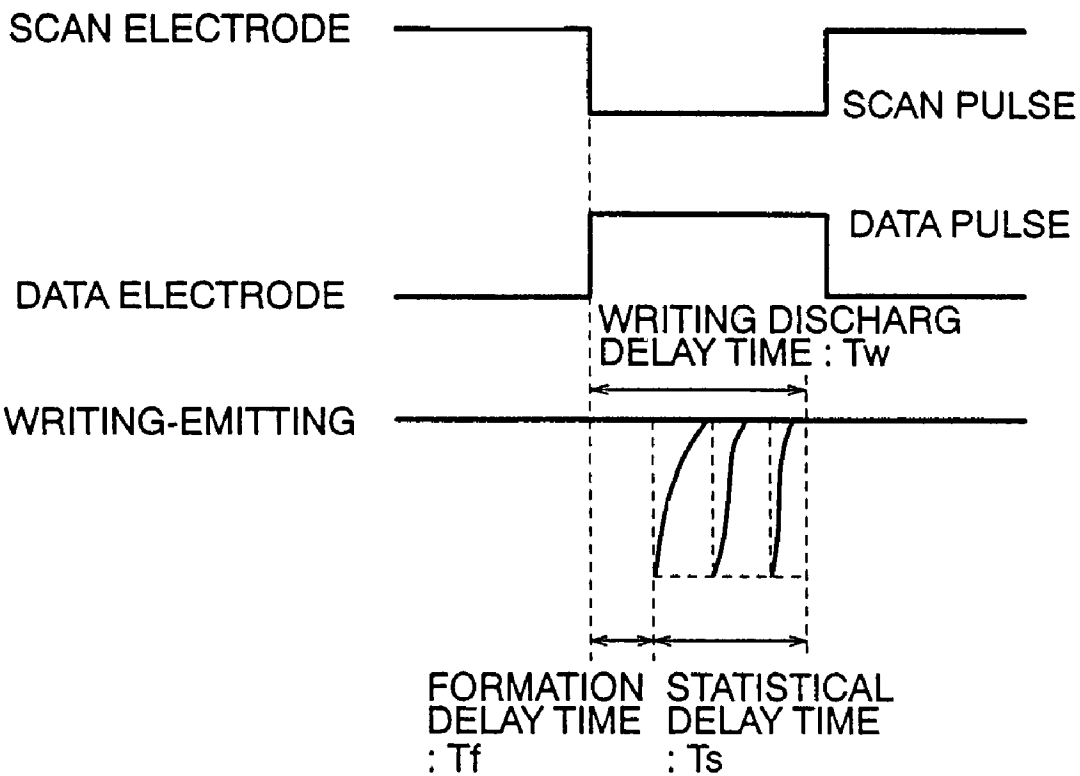
FIG. 4 (PRIOR ART)
FIG. 4 is a timing chart showing discharge delay time.
Figure 5:
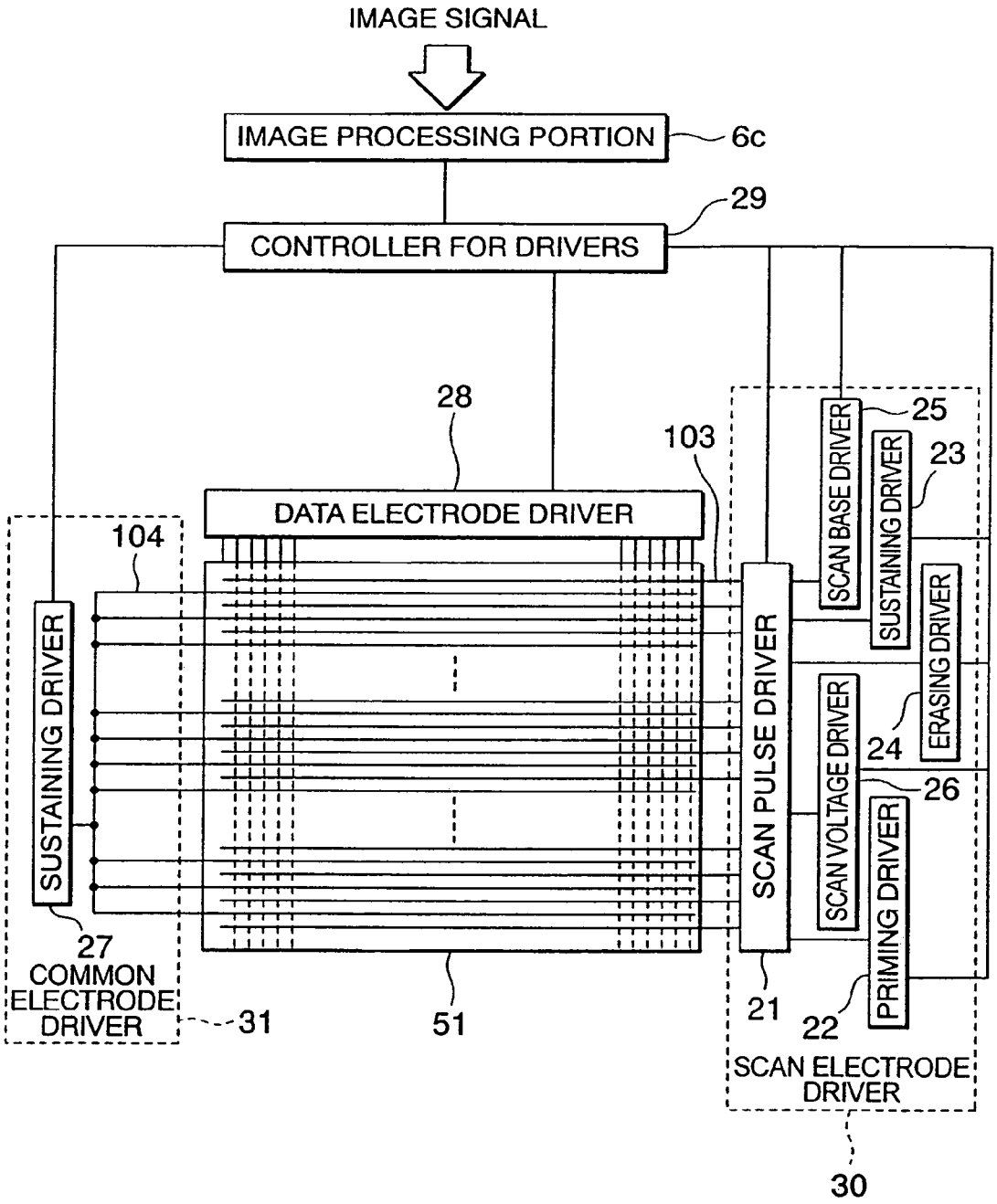
FIG. 5 (PRIOR ART)
FIG. 5 is a block diagram illustrating a driving circuit employed by the conventional plasma display.
Figure 6A:
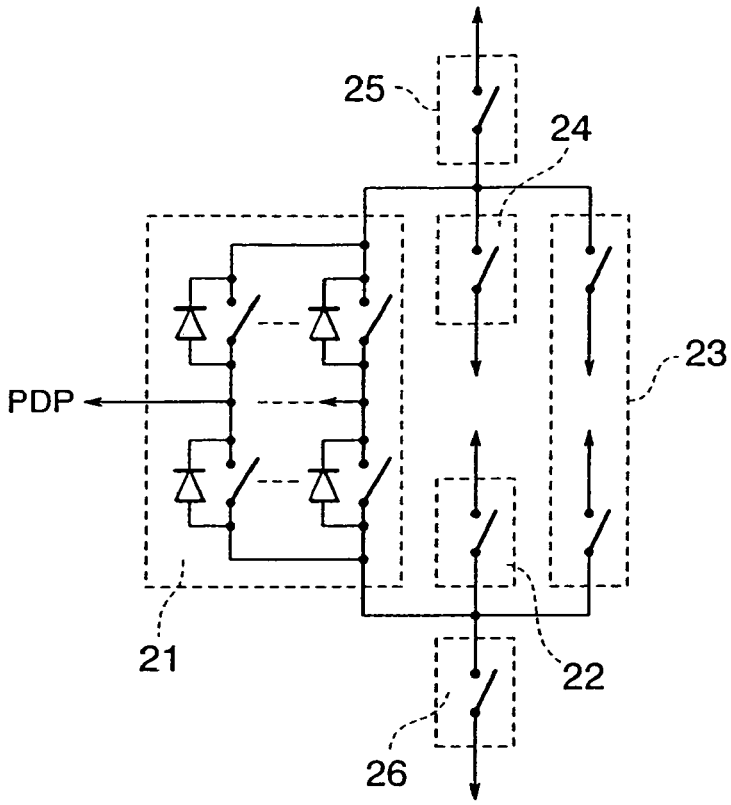
FIG. 6A (PRIOR ART)
FIG. 6A is a diagram illustrating a driving circuit for scan electrodes 103.
Figure 6B:
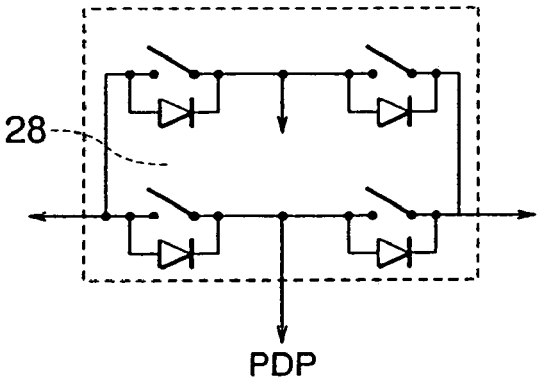
FIG. 6B (PRIOR ART)
FIG. 6B is a diagram illustrating a driving circuit for common electrodes 104.
Figure 6C:
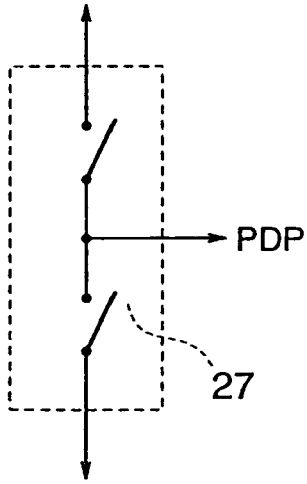
FIG. 6C (PRIOR ART)
FIG. 6C is a diagram illustrating a data electrode driver 28.
Figure 7:
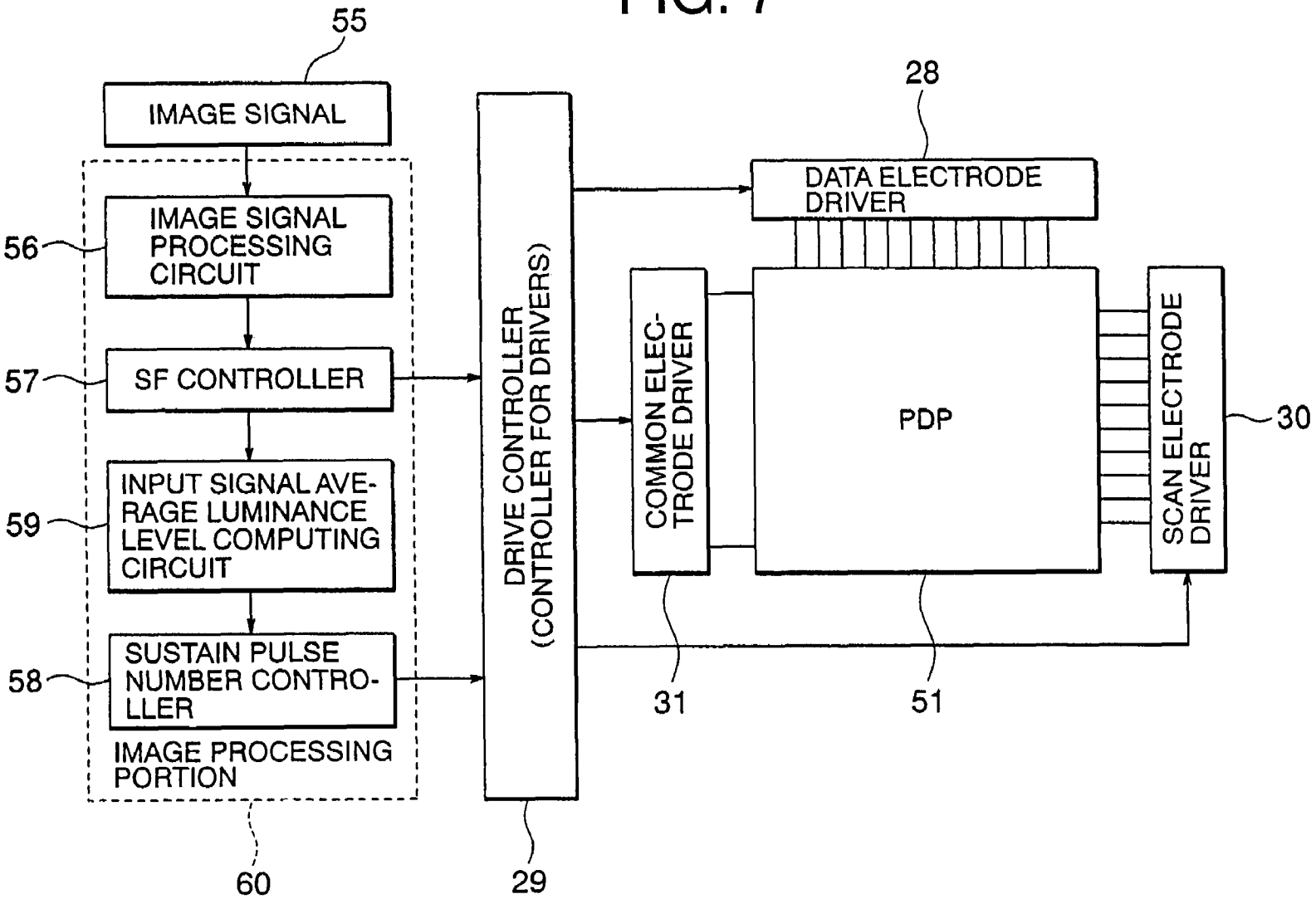
FIG. 7 is a circuit diagram illustrating a conventional plasma display employing a PLE control.
Figure 8:
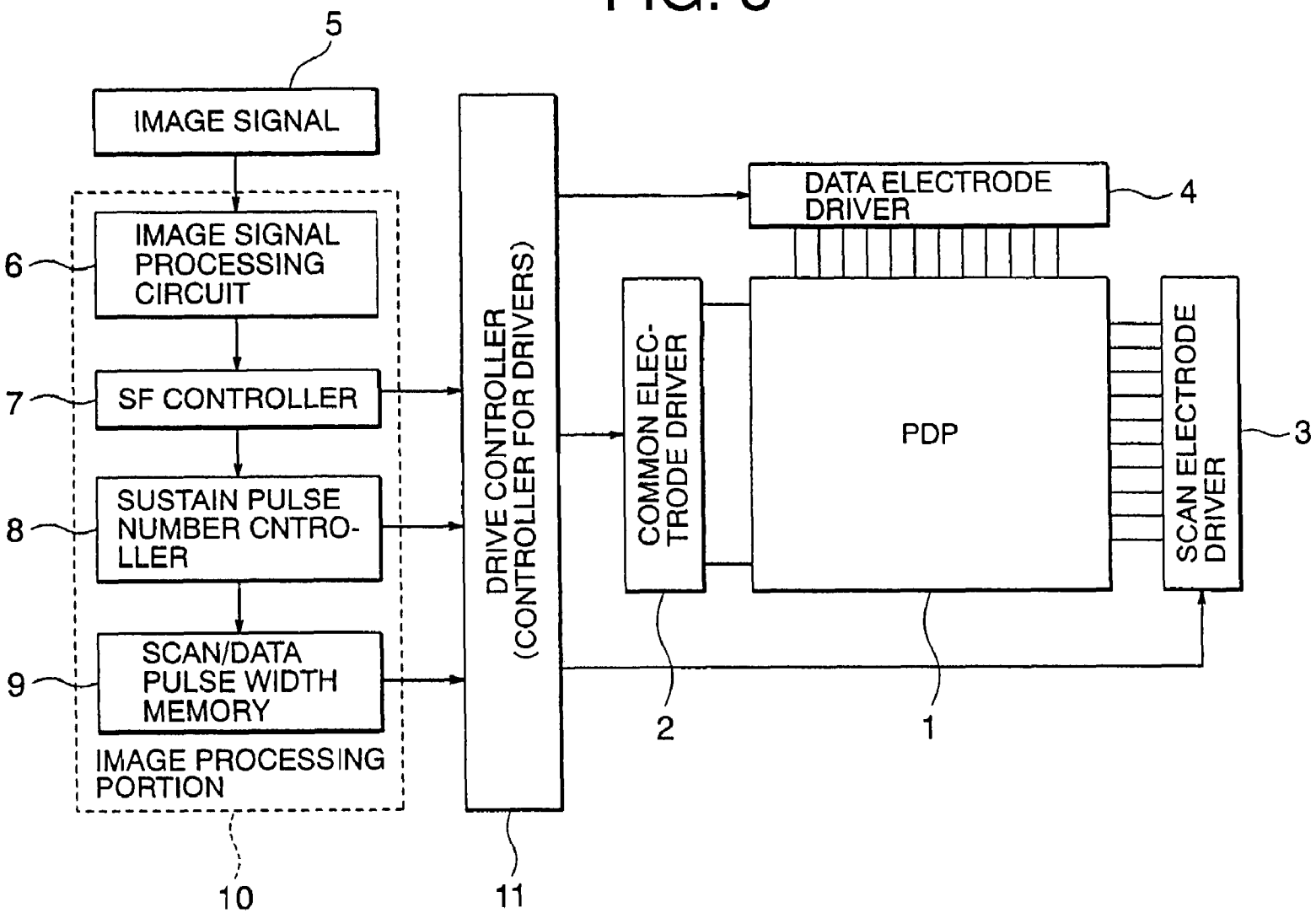
FIG. 8 is a block diagram illustrating the configuration of a driving circuit for an AC plasma display according to a first embodiment of the present invention.

Now, the preferred embodiments of the present invention will be specifically explained with reference to the accompanying drawings. FIG. 8 is a block diagram illustrating the configuration of a driving circuit for an AC plasma display according to a first embodiment of the present invention.

The driving circuit according to the first embodiment is provided with an image signal processing circuit 6 for performing processing such as A/D conversion and inverse γ processing and the like on inputted image signals. There is also provided a sub-field (SF) controller 7 for arranging the output signal from the image signal processing circuit 6 in each sub-field and forming the signal into an image signal available for use in a plasma display. Furthermore, there is provided a sustain pulse number controller 8 for inputting the output signal from the SF controller 7 and outputting a predetermined number of sustain pulses of each sub-field. Still furthermore, there is provided a scan/data pulse width memory 9 for inputting data on the number of sustain pulses of each sub-field which is outputted from the sustain pulse number controller 8 and outputting, based on the data, the width of the scan and data pulses of each sub-field, stored in advance in the memory. Thus, the image signal processing circuit 6, the SF controller 7, the sustain pulse number controller 8, and the scan/data pulse width memory 9 constitute an image processing portion 10.

Moreover, the driving circuit according to the first embodiment has a drive controller 11 for inputting the output signals from each of the SF controller 7, the sustain pulse number controller 8, and the scan/data pulse width memory 9. Still moreover, the driving circuit has a common electrode driver 2, a scan electrode driver 3, and a data electrode driver 4, which are connected to a plasma display panel 1 and controlled by the drive controller 11. Incidentally, a read only memory (ROM) and the like are built in the drive controller 11. In the read only memory stored is data for controlling the common electrode driver 2, the scan electrode driver 3, and the data electrode driver 4 in association with the output signals from the SF controller 7, the sustain pulse number controller 8, and the scan/data pulse width memory 9.

Now, the operation of the first embodiment configured as described above will be explained below.

First, an image signal 5 inputted to the plasma display is inputted to the image signal processing circuit 6 to be subjected to the A/D conversion and the inverse γ processing. Then, the resulting image signal is arranged in the SF controller 7 for each sub-field to form into an image signal available for use in the plasma display. Thereafter, a predetermined number of sustain pulses for each sub-field are outputted from the sustain pulse number controller 8. Then, the data on the number of sustain pulses for each sub-field, outputted from the sustain pulse number controller 8, is inputted to the scan/data pulse width memory 9 to output the width of the scan and data pulse of each sub-field, stored in advance in the memory 9. The output signals from the SF controller 7, the sustain pulse number controller 8, and the scan/data pulse width memory 9 are inputted to the controller for drivers 11 to control the operation of the common electrode driver 2, the scan electrode driver 3, and the data electrode driver 4, based on the output signals.

Figure 9:
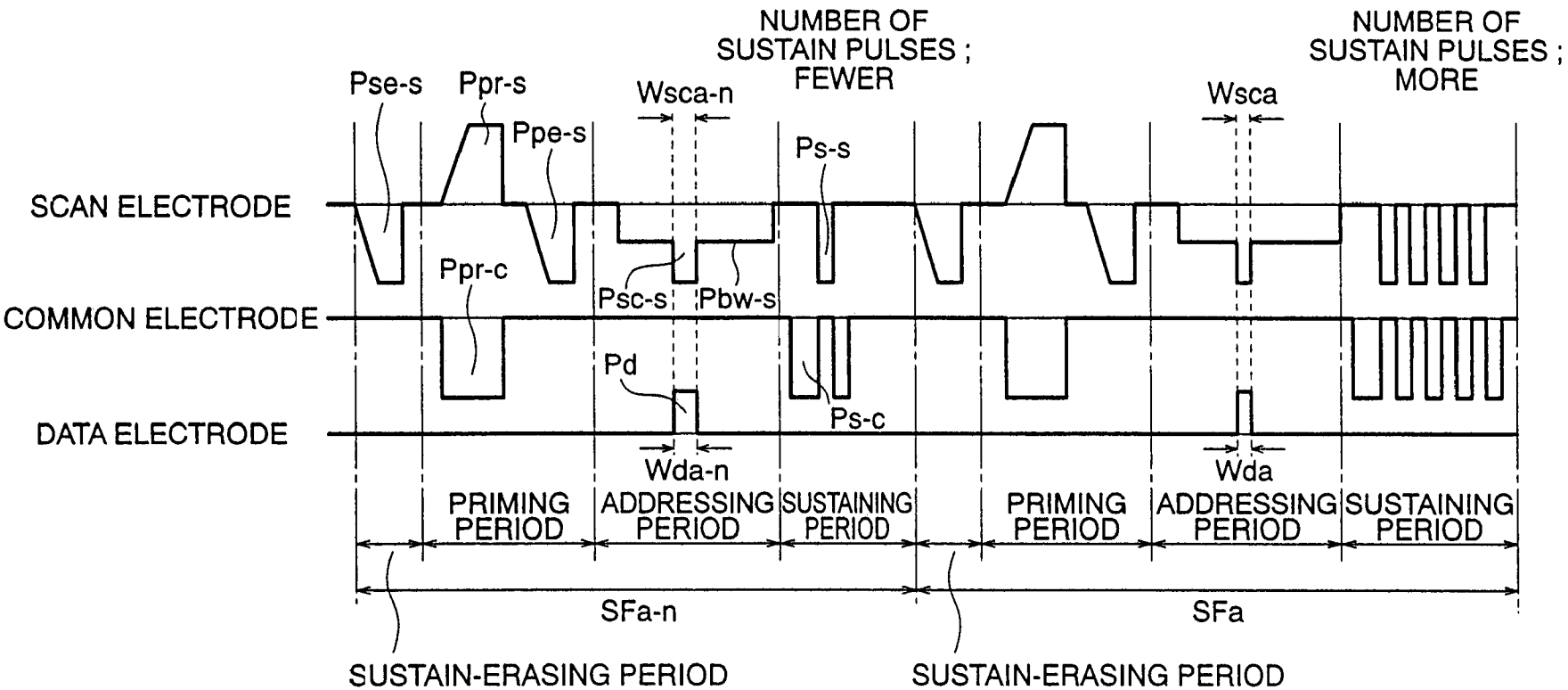
FIG. 9 is a timing chart illustrating the operation of a common electrode driver 2, a scan electrode driver 3, and a data electrode driver 4 in a driving circuit according to the first embodiment of the present invention.

FIG. 9 is a timing chart illustrating the operation of the common electrode driver 2, the scan electrode driver 3, and the data electrode driver 4 in the driving circuit according to the first embodiment of the present invention.

Each of sub-field consists of a sustain-erasing period, a priming period, an addressing period, and a sustaining period, which are set in sequence.

During the sustain-erasing period, a negative sustain erase pulse Pse-s is applied to the scan electrode from the scan electrode driver 3.

During the priming period, a positive pulse Ppr-s is applied to the scan electrode from the scan electrode driver 3, while a negative pulse Ppr-c is applied to the common electrode (sustaining electrode) from the common electrode driver 2. Incidentally, the pulses Ppr-s and Ppr-c, having different waveforms from each other, are applied at the same time. Thereafter, a negative pulse Ppe-s is applied to the scan electrode from the scan electrode driver 3.

During the subsequent addressing period, a negative pulse Pbw-s is applied to the scan electrode all the time from the scan electrode driver 3. Furthermore, suppose a negative scan pulse Psc-s is applied successively from the scan electrode driver 3 to each scan electrode, shifted in time from each other. In a discharge cell in which light emission to be caused, a positive data pulse Pd is applied from the data electrode driver 4 in synchronization with the scan pulse Psc-s to the data electrode passing through the discharge cell.

Incidentally, the widths of the scan pulse Psc-s and data pulse Pd are adjusted in accordance with the number of sustain pulses and the writing discharge delay time Tw in the subsequent sustaining period.

During the subsequent sustaining period, a negative sustain pulse Ps-c is applied to the common electrode from the common electrode driver 2, while a negative sustain pulse Ps-s is applied from the scan electrode driver 3 to the scan electrode. The sustain pulses Ps-c and Ps-s are alternately applied.

The number of pulses in the sustaining period is determined by the output signal from the sustain pulse number controller 8. However, FIG. 9 shows only a sub-field SFa-n provided with a less number of sustain pulses and a sub-field SFa provided with a larger number of sustain pulses. Take Wsca-n and Wda-n as the widths of the scan and data pulses in the sub-field SFa-n, respectively, and Wsca and Wda as the widths of the scan and data pulses in the sub-field SFa, respectively. In this embodiment, for example, letting Wsca-n=Wda-n and Wsca=Wda, the widths of the scan and data pulses are adjusted so as to satisfy that Wsca-n>Wsca. That is, the widths of the scan and data pulses in the sub-field SFa-n provided with a less number of sustain pulses are made greater than those of the sub-field SFa provided with a larger number of sustain pulses.

In addition, the scan pulse width Wsc and the data pulse width wd are set so as to be equal to or greater than the writing discharge delay time Tw (the formation delay time Tf+the statistical delay time Ts) in each sub-field.

Figure 10:
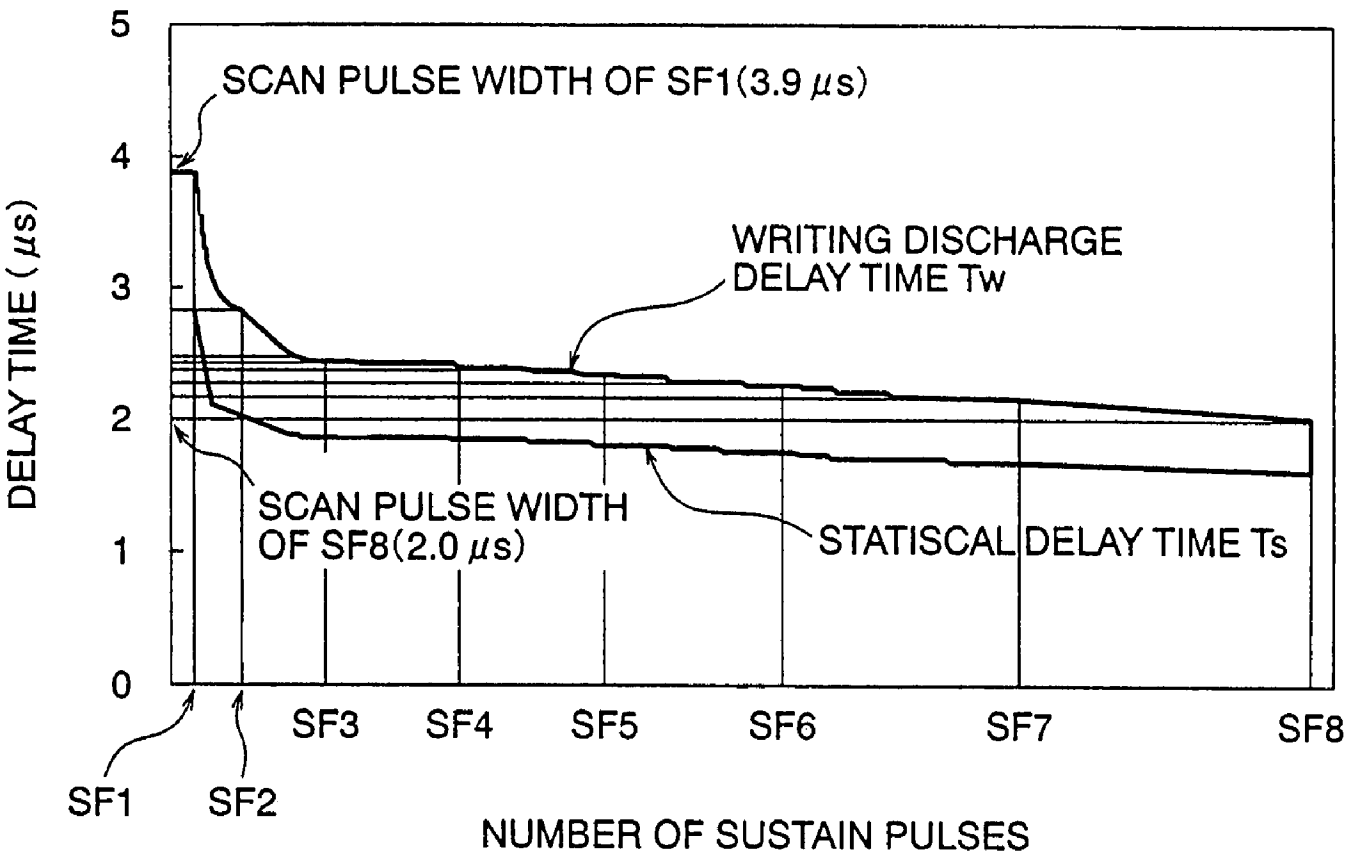
FIG. 10 is a graphical representation of the relationship among the number of sustain pulses, the writing discharge delay time Tw, and the statistical delay time Ts in sub-fields.

FIG. 10 is a graphical representation of the relationship among the number of sustain pulses, the writing discharge delay time Tw, and the statistical delay time Ts in sub-fields.

As described above, the writing discharge delay time Tw is the sum of the statistical delay time Ts and the formation delay time Tf. The scan and data pulse widths Wsc, Wd need to satisfy that Wsc≧Tw and Wd≧Tw with respect to the writing discharge delay time Tw.

The statistical delay time Ts is strongly affected by excited molecules and atoms present in a discharge space. The time Ts becomes shorter as the number of excited molecules and atoms present in the discharge space increases, whereas the time Ts becomes longer as the number of the molecules and atoms decreases. Therefore, as shown in FIG. 10, in a sub-field provided with a larger number of sustain pulses, the statistical delay time Ts becomes shorter because of the presence of a larger number of excited molecules and atoms, which are generated by the light emission of the sub-field itself. In a sub-field provided with a less number of sustain pulses, the statistical delay time Ts becomes longer.

On the other hand, the formation delay time Tf is determined by the kind and pressure of the gas, the applied voltage, and the structure of the discharge cell, and takes on a definite value to some extent under a constant condition, thus being made independent of the number of sustain pulses. For this reason, as shown in FIG. 10, the writing discharge delay time Tw is the sum of the statistical delay time Ts and the formation delay time Tf of a constant value.

Figure 11:
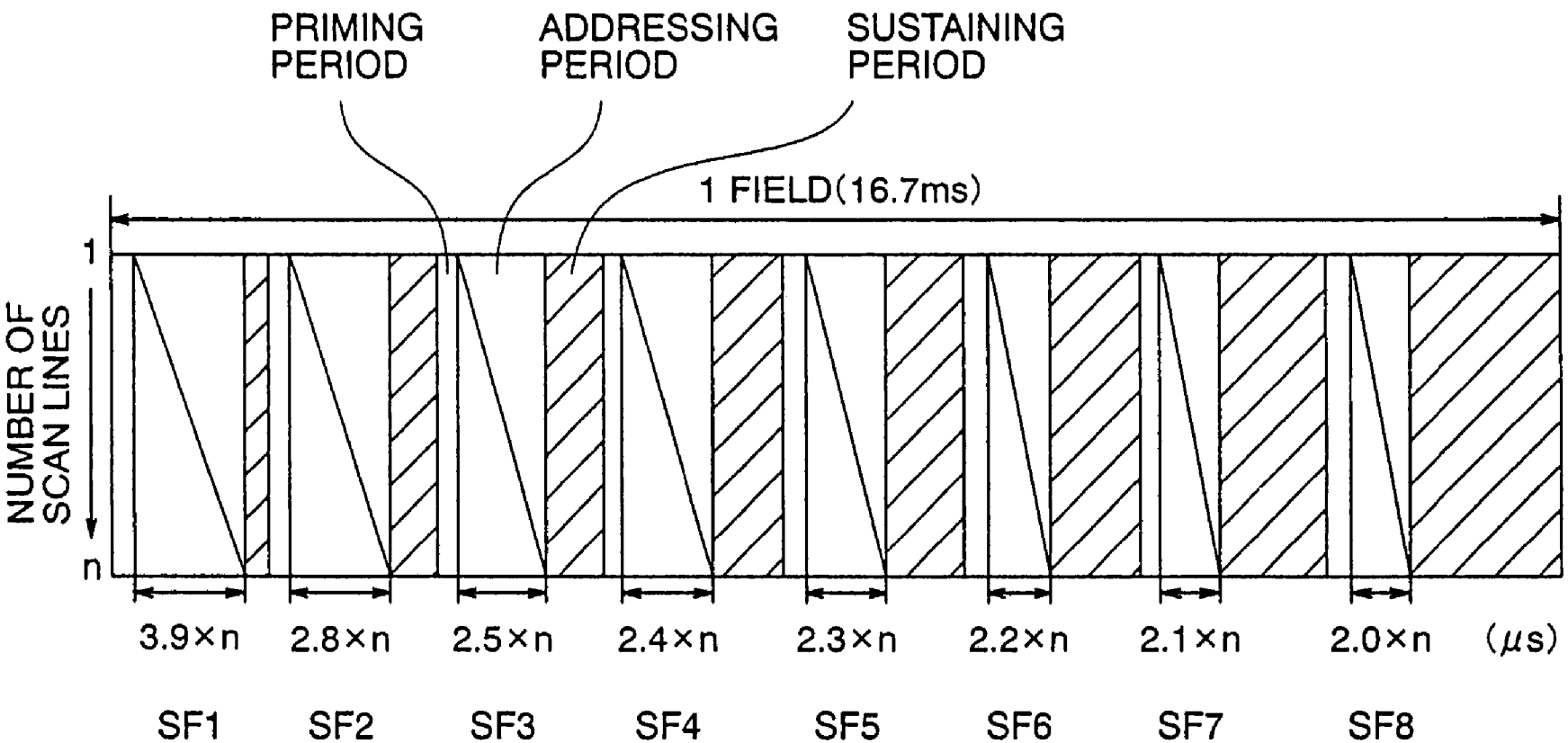
FIG. 11 is a schematic view illustrating the configuration of one field in the first embodiment.

FIG. 11 is a schematic view illustrating the configuration of one field in the first embodiment. In the first embodiment, as described above, the scan pulse width Wsc and data pulse width Wd decrease as the number of sustain pulses increases, that is, as the sub-field proceeds from SF1 to SF8. Thus, as shown in FIG. 11, a different length of time is required for the addressing period in each sub-field. Consequently, the overall addressing period in one frame is made shorter than in a conventional frame in which the length of time required for an addressing period is uniform in all sub-fields.

As described above, in the first embodiment, the scan pulse width Wsc and the data pulse width Wd are so set in each sub-field as to be equal to or greater than the writing discharge delay time Tw (the formation delay time Tf+the statistical delay time Ts) of the sub-field, thus causing no trouble such as write failure.

Consequently, this embodiment makes it possible to significantly reduce the length of time of the addressing period without degradation in drive property, when compared with the conventional driving circuit and driving method, in which all sub-fields are provided with the same pulse width and a length of time longer than necessary is set to the addressing period in a sub-field provided with a larger number of sustain pulses. Thus, this allows the total addressing period in a whole frame (=Wsc×the number of scan electrodes×the number of sub-fields) to be made shorter than the conventional one. Accordingly, the shortened length of time can be assigned to the sustaining period. It is thereby made possible to increase the number of times of sustaining light emission to improve luminance, increase the number of sub-fields to improve levels of gradation, and prevent a decrease in sustaining period caused by an increase in number of scan electrodes intended for higher resolution.

Now, a second embodiment of the present invention is explained. Let the sub-field selected before the sub-field SFa be a sub-field SFa-n in a frame. The second embodiment varies the scan pulse width Wsca and the data pulse width Wda of the sub-field SFa in association with the number of sustain pulses n of the sub-field SFa-n and the time T from the end of the sub-field SFa-n to the start of the sub-field SFa. The first embodiment adjusts the scan pulse width Wsc and data pulse width Wd of the sub-field SFa, which constitutes a frame, in association with the number of sustain pulses in the sub-field SFa, thereby providing an effect of shortening the total addressing period while keeping the drive property in a good condition. The second embodiment also provides the same effect.

Figure 12:
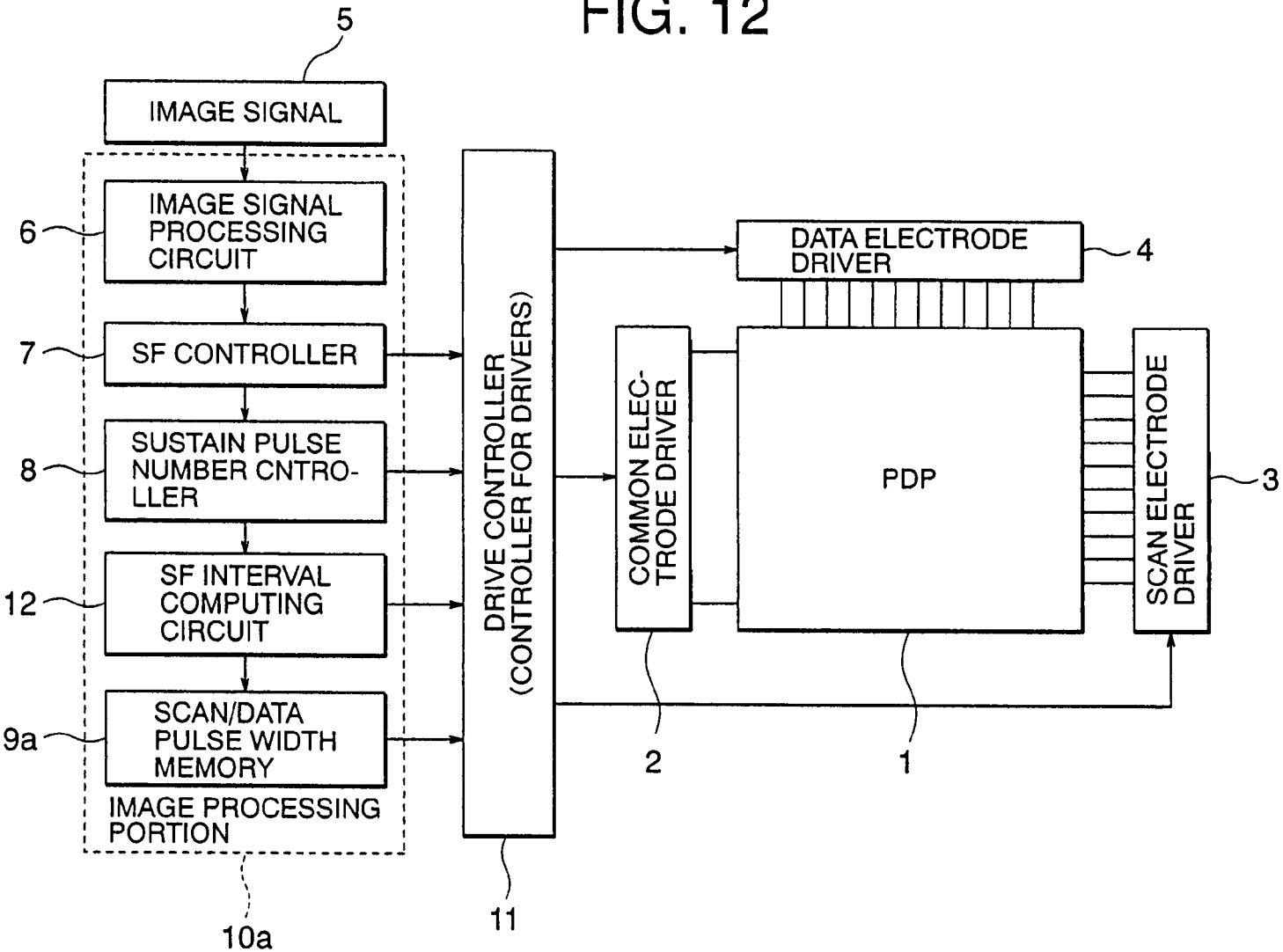
FIG. 12 is a block diagram illustrating the configuration of a driving circuit according to a second embodiment of the present invention.

FIG. 12 is a block diagram illustrating the configuration of a driving circuit according to the second embodiment of the present invention. Incidentally, in the second embodiment shown in FIG. 12, the same components as those of the first embodiment shown in FIG. 8 are given the same reference symbols and will not be detailed.

In the second embodiment, there is provided an image processing portion 10*a* with a sub-field (SF) interval computing circuit 12 for inputting the output signal (image signal) from the sustain pulse number controller 8 in the first embodiment and computing time T between the sub-fields SFa-n and SFa in the way of selecting each sub-field (hereinafter referred to as the "coding") and then output the result. In addition, instead of the scan/data pulse width memory 9 in the first embodiment, there is provided a scan/data pulse width memory 9*a* for storing the data on the scan pulse width Wsc and data pulse width Wd, which are determined in each sub-field in consideration of the time T between the sub-fields SFa-n and SFa and the number of sustain pulses n in the sub-field SFa-n as well as the data stored in the scan/data pulse width memory 9. The scan/data pulse width memory 9*a* outputs the scan pulse width Wsc and data pulse width Wd of each sub-field in accordance with the result computed by the SF interval computing circuit 12.

FIG. 13 is a view illustrating the weighting of each sub-field and the coding of an input signal of a plasma display, which are employed by the second embodiment of the present invention. The coding weighted as shown in FIG. 13 possibly allows the sub-fields SF1-SF3 to be selected individually. However, the sub-field SF4 and the subsequent sub-fields are selected together with at least another sub-fields enclosed with the double frames in FIG. 13, thus being never selected alone but in conjunction with one or more sub-fields. Incidentally, the data shown in FIG. 13 is stored, for example, in a ROM built in the drive controller (controller for drivers) 11.

Figure 14:
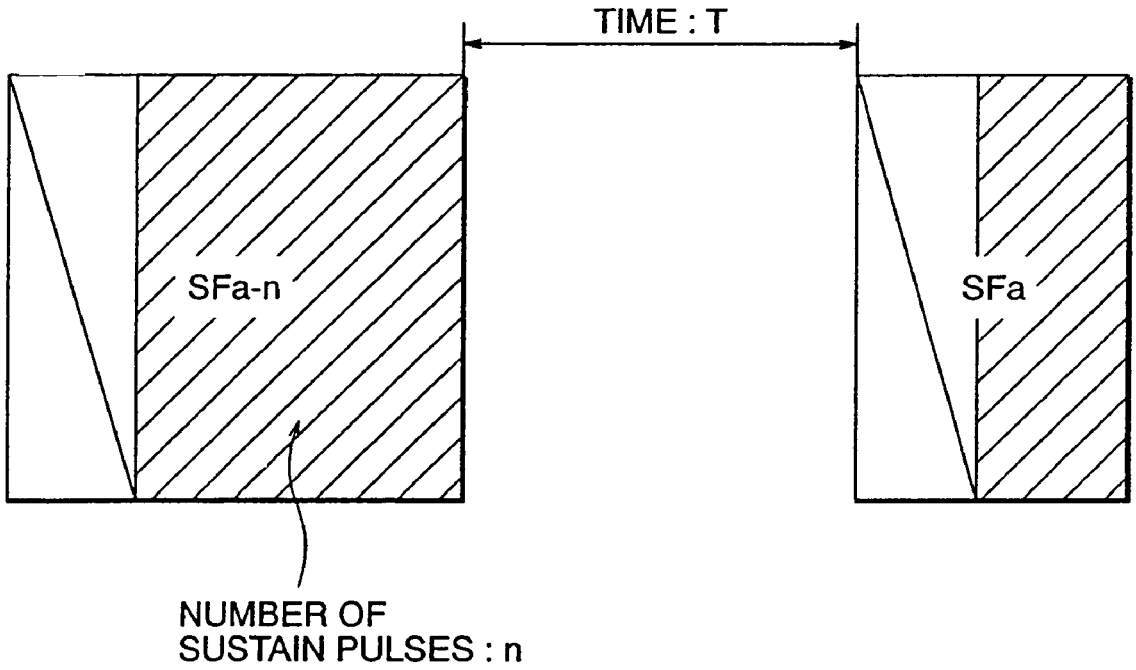
FIG. 14 is a schematic view illustrating the relationship between the sub-fields selected at the same time in the second embodiment of the present invention.

For simplicity, an explanation is given to two sub-fields SFa-n and SFa, which are selected at the same time in the same frame shown in FIG. 14. Take n as the number of sustain pulses in the sub-field SFa-n and T as a length of time from the end of the sub-field SFa-n to the start of the sub-field SFa.

Figure 15:
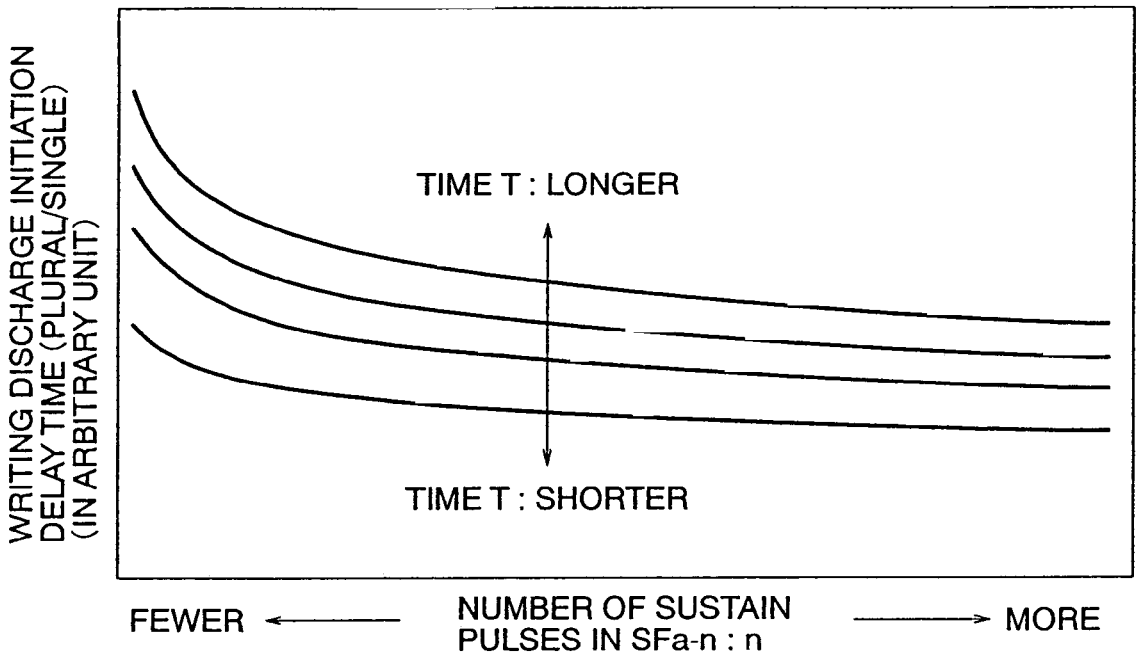
FIG. 15 is a graphical representation of the relationship between the number of sustain pulses n in the sub-field SFa-n and the relative ratio of the writing discharge initiation delay time with time T being varied in the range from sub-field SFa-n to SFa.
Figure 16:
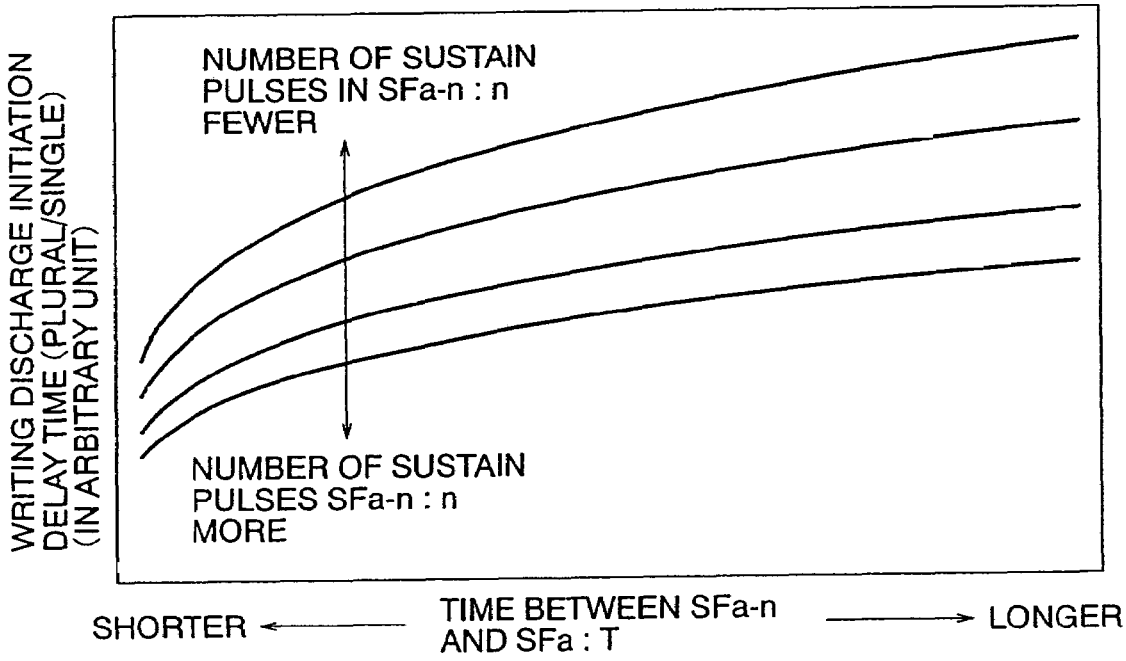
FIG. 16 is a graphical representation of the relationship between time T in the range from sub-field SFa-n to SFa and the relative ratio of the writing discharge initiation delay time with the number of sustain pulses n being varied.

FIG. 15 is a graphical representation of the relationship between the number of sustain pulses n in the sub-field SFa-n, represented on the horizontal axis, and the relative ratio of the writing discharge initiation delay time, represented on the vertical axis, with the time T being varied in the range from the sub-field SFa-n to SFa. FIG. 16 is a graphical representation of the relationship between time T in the range from sub-field SFa-n to SFa, represented on the horizontal axis, and the relative ratio of the writing discharge initiation delay time, represented on the vertical axis, with the number of sustain pulses n being varied. Incidentally, the graph shows the case where only the two sub-fields SFa-n and SFa are allowed to emit light. In addition, the relative ratio of the writing discharge initiation delay time is a ratio of the writing discharge delay time of the sub-field SFa in the light emission provided by both sub-fields SFa and SFa-n to the writing discharge delay time in the light emission provided only by the sub-field SFa.

The light emission provided by the sub-field SFa-n causes the writing discharge delay time Twa of the sub-field SFa to be shorter than the writing discharge delay time given when no light emission is provided by the sub-field SFa-n. In addition, the writing discharge delay time Twa depends on the number of sustain pulses n of the sub-field SFa-n and the time T between the sub-fields SFa-n and SFa. The effect of shortening the writing discharge delay time Twa becomes greater as the time T is made shorter between the sub-fields SFa-n and SFa as shown in FIG. 15, and as the number of sustain pulses n becomes larger in the sub-field SFa-n as shown in FIG. 16.

The writing discharge delay time Twa is varied with the number of sustain pulses n of the sub-field SFa-n because the sustain discharge for providing light emission in the sub-field SFa-n produces a different number of excited molecules and atoms present in a discharge space depending on the number of times of sustain discharges (the number of sustain pulses), which affects the statistical delay time Tsa in the sub-field SFa. As described above, although not shown in FIG. 14, the greater the number of times of sustain discharges in the previous sub-field SFa-n, the shorter the writing discharge delay time Twa of the sub-field SFa becomes. This shows that the same effect can be provided by a larger number of sub-fields that provide light emission before the sub-field SFa-n.

Therefore, as shown in FIG. 13, for example, the sub-field SF1 provides light emission and then the sub-field SF4 provides light emission to express gradation level 8. In this case, the number of sustain pulses of the sub-field SF1 enclosed with a double frame in FIG. 13 and the time between the sub-field SF1 and the sub-field SF4 enclosed likewise with a double frame are taken into consideration in the second embodiment. This makes it possible to make the scan pulse width Wsc and data pulse width Wd of the sub-field SF4 narrower than the pulse width that is determined in consideration of only the number of sustain pulses in each sub-field as in the first embodiment.

In addition, for example, sub-fields SF2, SF4, SF6, SF7, SF8, and SF10 provide light emission to express gradation level 182 as shown in FIG. 13. In this case, the number of sustain pulses of the sub-field SF8 enclosed with a double frame in FIG. 13 and the time between the sub-field SF8 and the sub-field SF10 enclosed likewise with a double frame are taken into consideration.

That is, as shown in FIG. 13, to express gradation level 15 and the subsequent gradation levels, the time between the sub-field providing the last light emission and the sub-field providing light emission immediately before the last and the number of sustain pulses of the sub-field providing light emission immediately before the last are taken into consideration. This makes it possible to make the scan pulse width Wsc and data pulse width Wd narrower than those of the first embodiment.

Table 1 below shows the widths of scan and data pulses of each sub-field according to the first and second embodiments.

TABLE 1

| | Widths of scan and data pulses (μsec.) | | | | | | | | | |
|---|---|---|---|---|---|---|---|---|---|---|
| Embodiment | SF1 | SF2 | SF3 | SF4 | SF5 | SF6 | SF7 | SF8 | SF9 | SF10 |
| First | 3.9 | 2.8 | 2.5 | 2.4 | 2.3 | 2.2 | 2.1 | 2.0 | 1.9 | 1.8 |
| Second | 3.9 | 2.8 | 2.5 | 2.3 | 2.2 | 2.1 | 2.0 | 1.8 | 1.5 | 1.2 |

As shown in Table 1, the sub-fields SF1 to SF3 provide no difference for the widths of the scan and data pulses. In the second embodiment, however, it is made possible to shorten the widths of the scan and data pulses in the sub-field SF4 and the subsequent sub-fields, the time to which from the sub-field providing immediately previous light emission is taken into consideration.

Now, a third embodiment of the present invention will be explained. The third embodiment employs the first and second embodiments in addition to a control method called the "Peak Luminance Enhancement" (PLE). The PLE control provides a method for controlling the number of sustain pulses of each sub-field in a frame to reduce power consumption while enhancing peak luminance. As described in the first and second embodiments, a different number of sustain pulses of each sub-field provided by the PLE control would cause the writing discharge delay time Tw to be varied in each sub-field. The third embodiment allows the scan pulse width Wsc and data pulse width Wd of each sub-field to be varied according to the number of sustain pulses of each sub-field, which is set by the PLE control, as the number of sustain pulses is varied in each sub-field in a field.

Figure 17:
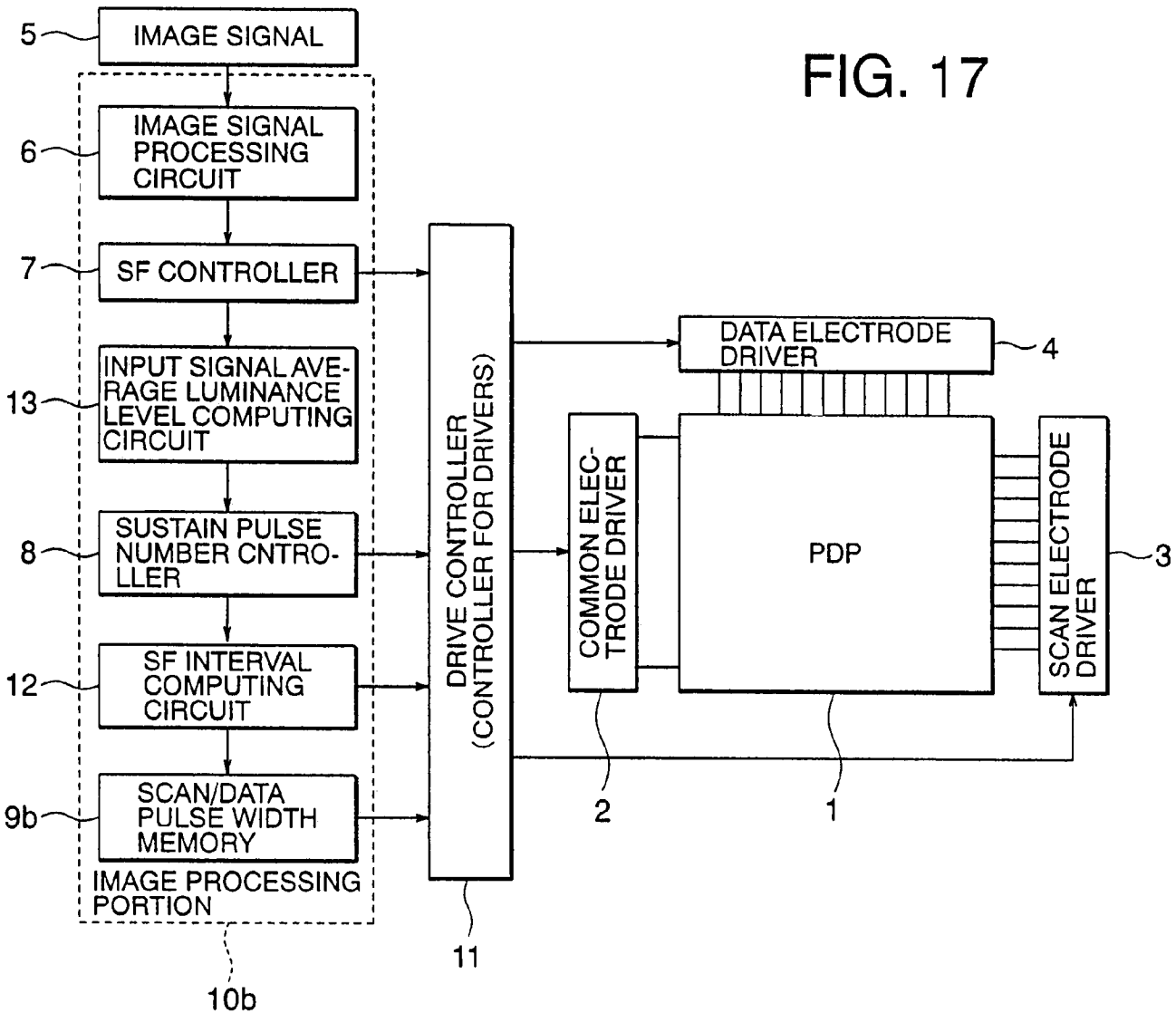
FIG. 17 is a block diagram illustrating the configuration of a driving circuit according to a third embodiment of the present invention.

FIG. 17 is a block diagram illustrating the configuration of a driving circuit according to the third embodiment of the present invention. Incidentally, in the third embodiment shown in FIG. 17, the same components as those of the first and second embodiments shown in FIGS. 8 and 12, respectively, are given the same reference symbols and will not be detailed.

In the third embodiment, an image processing portion (sustain pulse number varying circuit) 10*b* is provided with an input signal average luminance level (APL) computing circuit 13 for computing the display area and the luminance level of the screen in accordance with the output signal from the SF controller 7 in the second embodiment and outputting the result to the sustain pulse number controller 8. When the input signal average luminance level (APL) is high, or the average luminance level is high and the display area is large, the sustain pulse number controller 8 outputs a signal indicating that the total number of sustain pulses per frame is small, while outputting a signal indicating that the total number of sustain pulses is large when the input signal average luminance level (APL) is low.

In addition, instead of the scan/data pulse width memory 9 and 9*a*, there is provided, in the image processing portion 10*b*, a scan/data pulse width memory 9*b* for inputting the output signal from such a sustain pulse number controller 8.

For example, the scan/data pulse widths corresponding to the input signal average luminance levels (APL) shown in Table 2 are stored in advance in the scan/data pulse width memory 9*b*, which outputs data indicating the widths of scan and data pulses in accordance with the input signal average luminance level (APL) provided by the sustain pulse number controller 8.

TABLE 2

| Average luminance level | | SF1 | SF2 | SF3 | SF4 | SF5 | SF6 | SF7 | SF8 |
|---|---|---|---|---|---|---|---|---|---|
| 100% | Number of sustain pulses (Total: 255) | 1 | 2 | 4 | 8 | 16 | 32 | 64 | 128 |
| | Scan/data pulse width (μsec) | 5 | 4 | 3.5 | 3 | 2.5 | 2 | 1.8 | 1.5 |
| 50% | Number of sustain pulses (Total: 510) | 2 | 4 | 8 | 16 | 32 | 64 | 128 | 256 |
| | Scan/data pulse width (μsec) | 4 | 3.5 | 3 | 2.5 | 2 | 1.8 | 1.5 | 1.3 |
| 5% | Number of sustain pulses (Total: 1020) | 4 | 8 | 16 | 32 | 64 | 128 | 256 | 512 |
| | Scan/data pulse width (μsec) | 3.5 | 3 | 2.5 | 2 | 1.8 | 1.5 | 1.3 | 1 |

Incidentally, the relationship (PLE curve) between the number of sustain pulses and power was determined in advance to derive accordingly the data shown in Table 2.

As shown in Table 2, the widths of scan/data pulses are made narrower as the number of sustain pulses increases at any average luminance level.

Therefore, while varying the total number of sustain pulses by the PLE control, the third embodiment makes it possible to control the increase or decrease in number during addressing periods to prevent a variation in time required for the frame. For this reason, application of a larger number of sustain pulses makes it possible to enhance peak luminance and secure a large number of sub-fields to increase the number of gradation levels.

Incidentally, the first to third embodiments employ the AC plasma display panels, however, the present invention is not limited to the AC plasma display panel but can be applied to the DC plasma display panel as well. Furthermore, all embodiments employ the common electrode as the sustaining electrode, however, the present invention is not limited thereto but voltages having different waveforms from one another may be applied to a plurality of sustaining electrodes.

What is claimed is:

1. A driving method for driving a plasma display panel comprising the steps of:

applying scan pulses within an addressing period of a sub-field and then sustain pulses within a sustain period of said sub-field;

wherein a width of scan pulses appearing in a first sub-field are narrower than scan pulses appearing in a second sub-field when the number of sustain pulses of said first sub-field is more than in said second sub-field.

2. A driving method for driving a plasma display panel comprising the steps of:

applying scan pulses within an addressing period of a sub-field and then sustain pulses within a sustain period of said sub-field;

wherein a width of scan pulses appearing in a first sub-field following a second sub-field are narrower than scan pulses appearing in the second sub-field, while a time interval between the second sub-field and the first sub-field, which provides light emission just after the second sub-field, is decreased.

3. A driving method for driving a plasma display panel comprising the steps of:

applying scan pulses within an addressing period of a sub-field and then sustain pulses within a sustain period of said sub-field;

wherein a width of scan pulses appearing in a first sub-field are narrower than scan pulses appearing in a second sub-field when the number of sustain pulses in the second sub-field which proves light emission just previously to said first sub-field is less than in said first sub-field.

4. A driving method for driving a plasma display panel comprising the steps of:

applying scan pulses within an addressing period of a sub-field and then sustain pulses within a sustain period of said sub-field; and making the number of sustain pulses for a sustaining period in each sub-field larger as an average luminance level of a frame including said each sub-field decreases;

wherein a width of scan pulses appearing in a first sub-field are narrower than scan pulses appearing in a second sub-field when the number of sustain pulses of said first sub-field is more than in said second sub-field.

5. A driving circuit for driving a plasma display panel comprising:

a pulse applying portion which applies scan pulses within an addressing period of a sub-field and then sustain pulses within a sustain period of said sub-field;

wherein a width of scan pulses appearing in a first sub-field are narrower than scan pulses appearing in a second sub-field when the number of sustain pulses in said first sub-field is more than in said second sub-field.

6. A driving circuit for driving a plasma display panel comprising:

a period varying circuit which makes an addressing period of a sub-field shorter as the number of sustain pulses in a sustaining period in said sub-field increases, wherein said period varying circuit comprises:

a sub-field controller which arranges an inputted image signal in each sub-field;

a sustain pulse number controller which outputs the number of sustain pulses for a sustaining period in each sub-field in association with an output signal from said sub-field controller; and a memory circuit which stores pulse width of scan pulses in said addressing period, said pulse width being set in association with the number of said sustain pulses in said each sub-field.

7. A driving circuit for driving a plasma display panel comprising:

a pulse applying portion which applies scan pulses within an addressing period of a sub-field and then sustain pulses within a sustain period of said sub-field;

wherein a width of scan pulses appearing in a first sub-field following a second sub-field are narrower than scan pulses appearing in the second sub-field, while a time interval between the second sub-field and the first sub-field, which provides light emission just after the second sub-field, is decreased.

8. A driving circuit for driving a plasma display panel comprising:

a pulse applying portion which applies scan pulses within an addressing period of a sub-field and then sustain pulses within a sustain period of said sub-field;

wherein a width of scan pulses appearing in a first sub-field are narrower than scan pulses appearing in a second sub-field when the number of sustain pulses in the second sub-field which provides light emission just previously to said first sub-field is less than in said first sub-field.

* * * * *

UNITED STATES PATENT AND TRADEMARK OFFICE

CERTIFICATE OF CORRECTION

PATENT NO. : 7,355,568 B2
APPLICATION NO. : 11/491303
DATED : April 8, 2008
INVENTOR(S) : Homma It is certified that error appears in the above-identified patent and that said Letters Patent is hereby corrected as shown below:

At column 14, line 50 please replace “proves” with --provides--.

Signed and Sealed this

Fifth Day of August, 2008

JON W. DUDAS
*Director of the United States Patent and Trademark Office*